US006612003B1

(12) United States Patent
Liu

(10) Patent No.: US 6,612,003 B1
(45) Date of Patent: Sep. 2, 2003

(54) DOUBLE-BOW SHOE LACE DEVICE

(76) Inventor: Kun-Chung Liu, No. 5 Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 10/195,377

(22) Filed: Jul. 16, 2002

(51) Int. Cl.[7] ..... A43C 7/00
(52) U.S. Cl. ..... 24/712.5
(58) Field of Search ..... 36/50.1; 24/712–712.9, 24/115 G

(56) References Cited

U.S. PATENT DOCUMENTS 743,924 A * 11/1903 Pratt ..... 2/245
2,869,204 A * 1/1959 Mopps ..... 24/712.8
4,393,550 A * 7/1983 Yang et al. ..... 24/712.5
4,680,835 A * 7/1987 Horng ..... 24/712.5
5,097,573 A * 3/1992 Gimeno ..... 24/712.6
6,178,606 B1 * 1/2001 Glendon ..... 24/712.5
6,334,240 B1 * 1/2002 Li ..... 24/115 G
2003/0024083 A1 * 2/2003 Liu ..... 24/712

FOREIGN PATENT DOCUMENTS

GB 2343701 A * 5/2000 ..... F16G/11/10

* cited by examiner

*Primary Examiner*—James R. Brittain
(74) *Attorney, Agent, or Firm*—Foley & Lardner

(57) ABSTRACT

A double-bow shoe lace device includes a shoe lace, two loop assemblies, and a clamp member. The shoe lace has a first lace segment forming a criss-cross pattern on eyelet tabs of a shoe, and a second lace segment that includes first and second lace portions. Each lace portion has a lower section connected to the first lace segment. Each loop assembly includes a loop segment connected to an upper section of a respective one of the lace portions, and a distal lace segment. The clamp member is sleeved slidably on the loop assemblies. Downward and upward movements of the clamp member along the loop assemblies result in tightening and loosening of the shoe.

6 Claims, 7 Drawing Sheets

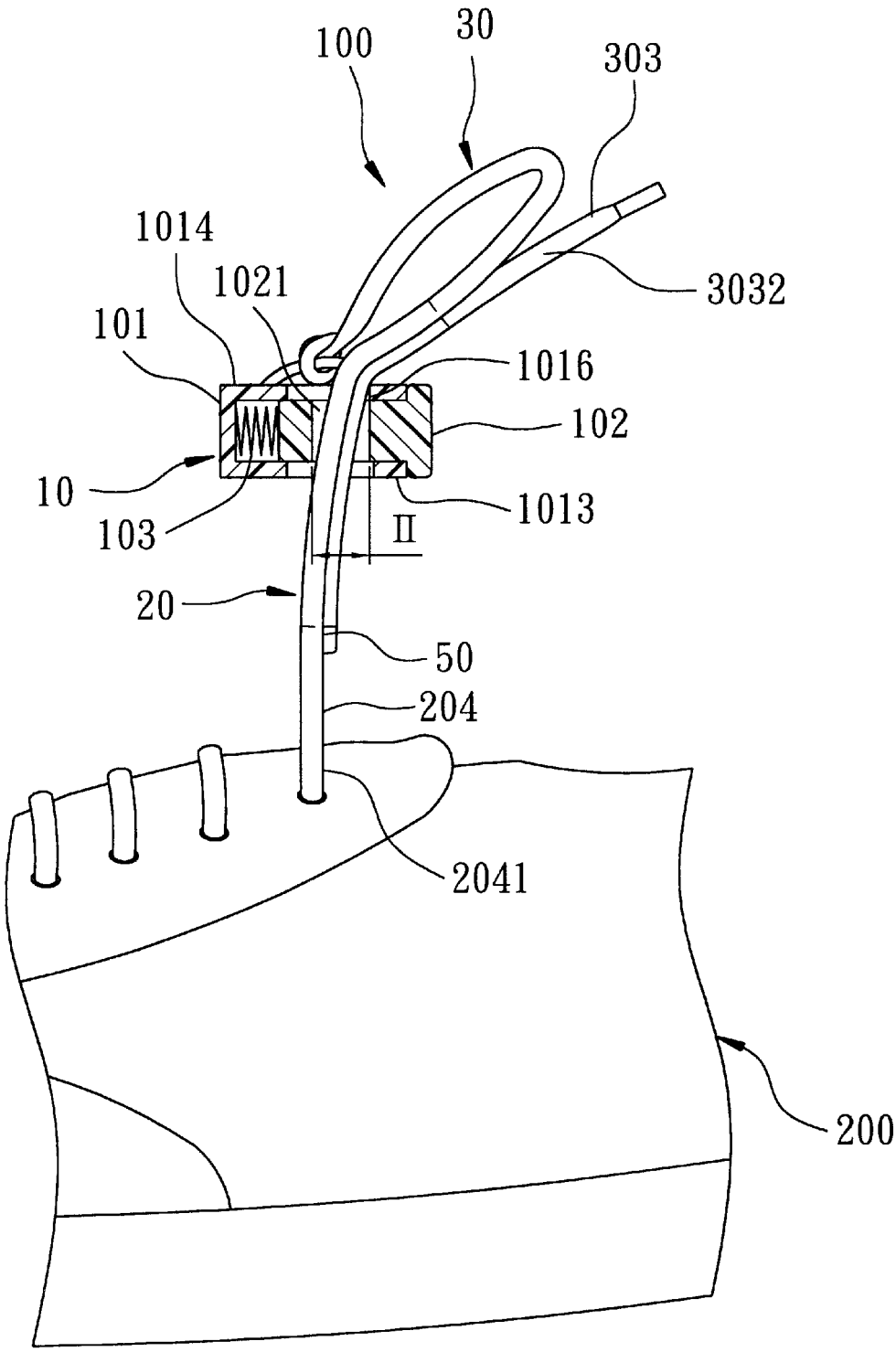
F-IG. 7

DOUBLE-BOW SHOE LACE DEVICE

BACKGROUND OF THE INVENTION

1. Field of the Invention

The invention relates to a shoe lace device, more particularly to a double-bow shoe lace device for a shoe.

2. Description of the Related Art

Referring to FIGS. 1 and 2, in U.S. patent application Ser. No. 09/920,965, filed by the applicant on Aug. 3, 2001, there is disclosed a double-bow shoe lace device 400 for a shoe 500 that includes a pair of eyelet tabs 510. The shoe lace device 400 comprises a shoe lace 1 having first and second lace segments 11, 12, a clamp member 2, a decorative knot 5, and a pair of pull members 3. The first lace segment 11 is adapted to be strung on the shoe 500 so as to form a criss-cross pattern on the eyelet tabs 510. The second lace segment 12 includes first and second lace portions 121, 122, each of which has lower, upper, and medial sections 1211, 1221, 1212, 1222, 1213, 1223. The lower section 1211, 1221 of each of the lace portions 121, 122 is connected to the first lace segment 11 so as to be adapted to be anchored on a respective one of the eyelet tabs 510. The clamp member 2 is sleeved slidably on the medial sections 1213, 1223 of the lace portions 121, 122, and includes an elongate casing 21 having first and second lace holes 211, 212, a clamping block 22 having a slot unit 221 that corresponds to the first lace hole 211, and a biasing member 23 with opposite ends that abut respectively against the clamping block 22 and a rear closed end of the casing 21. The medial sections 1213, 1223 of the lace portions 121, 122 extend through the first lace holes 211, back into the casing 21 via the second lace holes 212, and out of the casing 21 via the first lace hole 211 to connect with the knot 5, thus forming the medial sections 1213, 1223 of the lace portions 121, 122 into first and second loops (I, II), respectively. Each of the pull members 3 is mounted slidably on the loop (I, II) of a respective one of the medial sections 1213, 1223 of the lace portions 121, 122. The upper sections 1212, 1222 of the lace portions 121, 122 are tied together to form the decorative knot 5 that is connected to the medial sections 1213, 1223 of the lace portions 121, 122 and that has a pair of. distal lace ends 51 extending therefrom. The loops (I, II) and the knot 5 with the distal lace ends 51 cooperate to form a double-bow configuration.

In use, when the pull members 3 are pulled apart, the loops (I, II) of the medial sections 1213, 1223 become larger, forcing the clamp member 2 to slide downwardly along the lace portions 121, thereby bringing the lower sections 1211, 1221 of the latter closer together for tightening the shoe 500. To loosen the shoe 500, the biasing member 23 of the clamping block 2 is compressed so that the slot unit 221 is aligned with the first lace holes 211 in the casing 21. At this time, by moving the clamp member 2 upwardly along the lace portions 121, 122, the lower sections 1211, 1221 of the latter can be moved away from each other for loosening the shoe 500.

Although the aforesaid double-bow shoe lace device 400 can achieve its intended purpose, there is a need to provide a double-bow shoe lace with a more simple and reliable structure.

SUMMARY OF THE INVENTION

Therefore, the main object of the present invention is to provide a double-bow shoe lace device of the aforesaid type with a more simple and reliable structure.

According to the present invention, a double-bow shoe lace device is adapted for use with a shoe having a pair of eyelet tabs. The shoe lace device comprises a shoe lace, two loop assemblies, and a clamp member. The shoe lace has first and second lace segments. The first lace segment is adapted to be strung on the shoe so as to form a criss-cross pattern on the eyelet tabs. The second lace segment includes first and second lace portions. Each of the first and second lace portions has a lower section connected to the first lace segment so as to be adapted to be anchored on a respective one of the eyelet tabs, and an upper section opposite to the lower section. Each of the loop assemblies includes a first loop segment connected to the upper section of a respective one of the first and second lace portions, a second loop segment extending integrally from the first loop segment, and a distal lace segment fixed on the first loop segment. The clamp member is sleeved slidably on the loop assemblies and has the second loop segments of the loop assemblies secured thereto. Downward movement of the clamp member along the first loop segments of the loop assemblies brings the lower sections of the first and second lace portions closer together for tightening the shoe. Upward movement of the clamp member along the first loop segments of the loop assemblies permits the lower sections of the first and second lace portions to move away from each other for loosening the shoe.

BRIEF DESCRIPTION OF THE DRAWINGS

Other features and advantages of the present invention will become apparent in the following detailed description of the preferred embodiment with reference to the accompanying drawings, of which:

FIG. 7 is a fragmentary schematic partly sectional view illustrating the shoe with the preferred embodiment in a loosened state.

DETAILED DESCRIPTION OF THE PREFERRED EMBODIMENT

Figure 1:
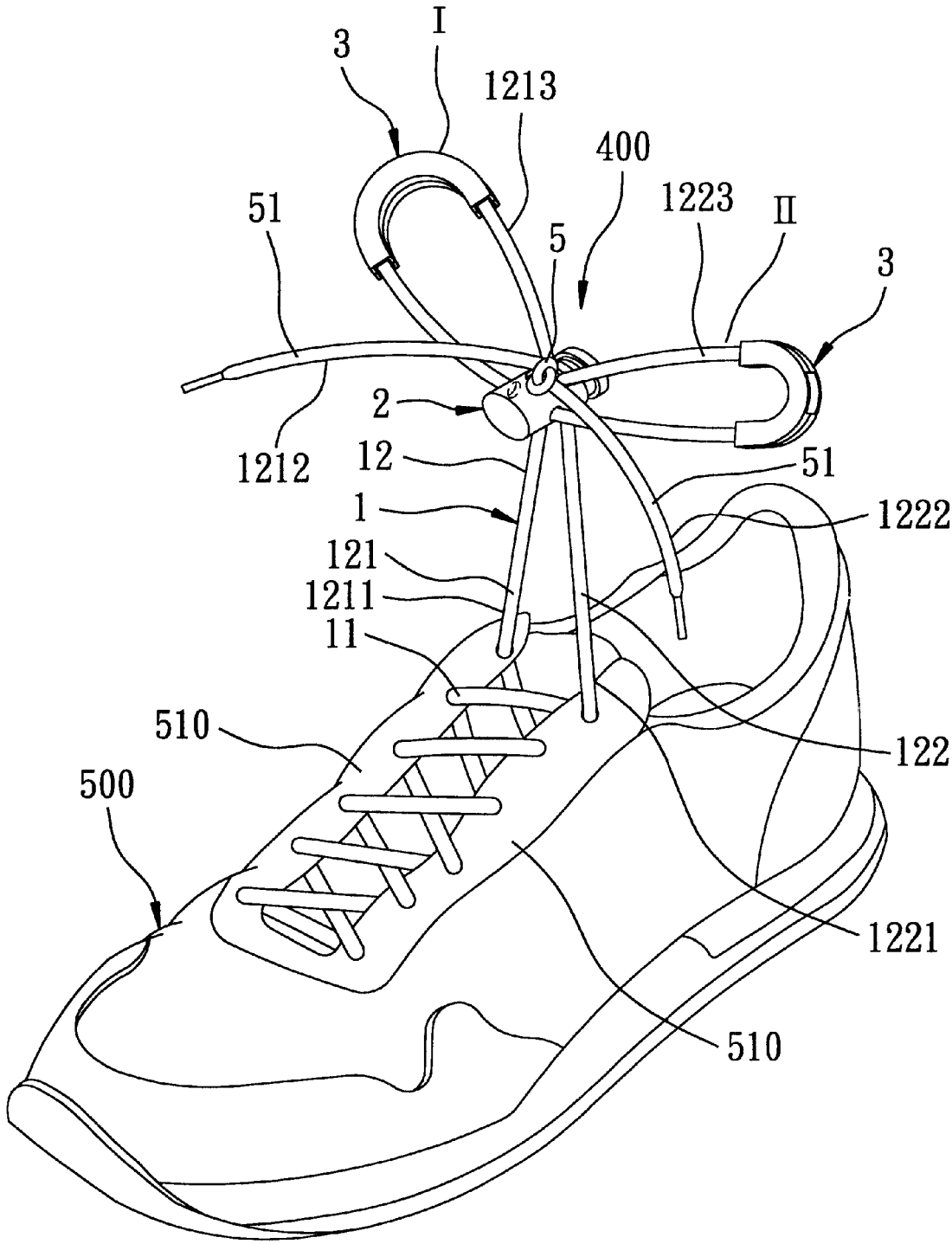
FIG. 1 PRIOR ART
FIG. 1 is a perspective view of a shoe that incorporates a double-bow shoe lace device according to U.S. patent application Ser. No. 09/920,965 by the applicant.
Figure 2:
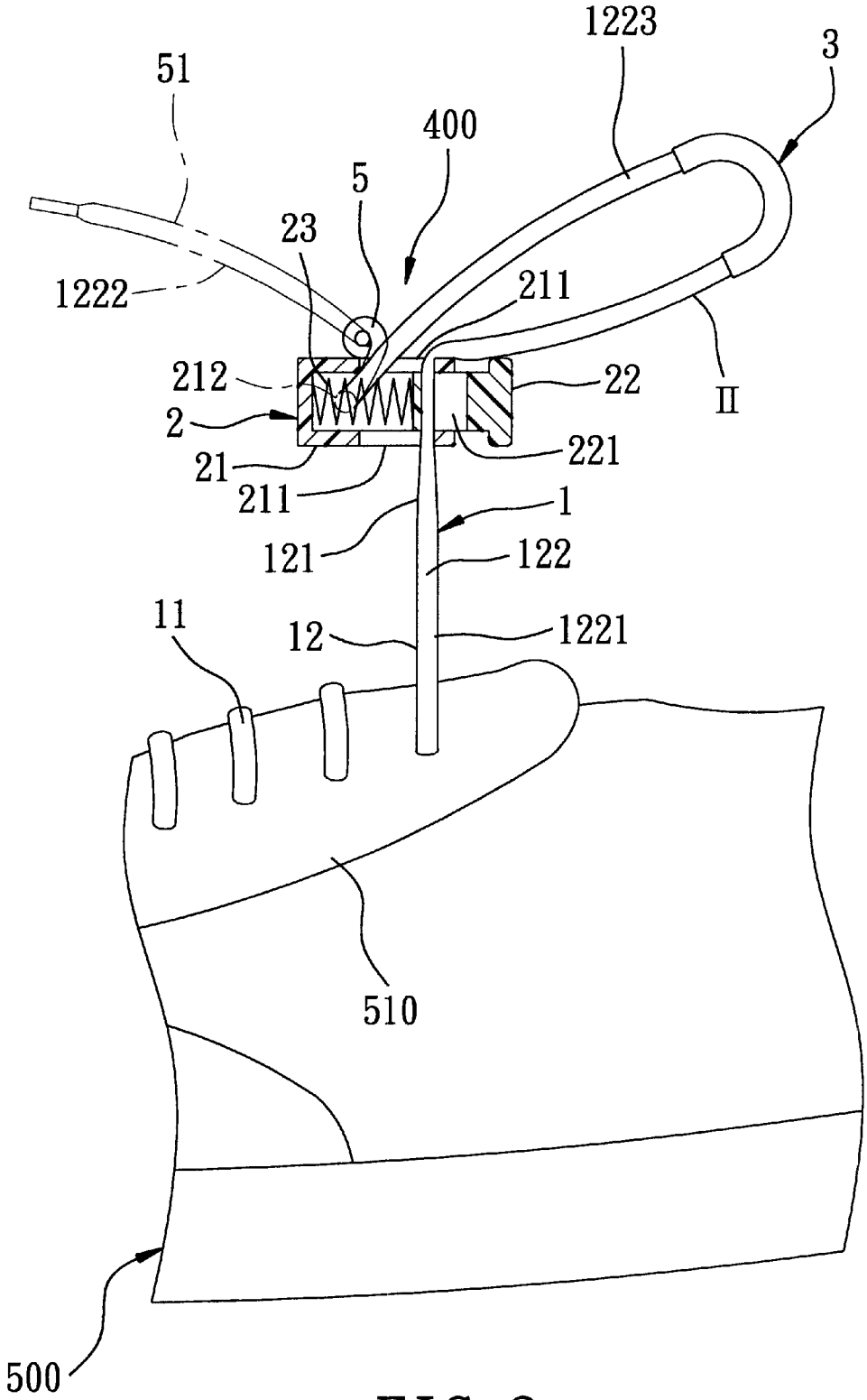
FIG. 2 PRIOR ART
FIG. 2 is a fragmentary schematic partly sectional view of FIG. 1, illustrating how a medial section of a lace portion extends into lace holes in the clamp member to form a loop.

Referring to FIGS. 3 to 7, the preferred embodiment of a double-bow shoe lace device 100 according to the present invention is shown to be adapted for use with a shoe 200 having a pair of eyelet tabs 210. The shoe lace device 100 comprises a shoe lace 20, two loop assemblies 30, and a clamp member 10.

The shoe lace 20 has first and second lace segments 201, 202. The first lace segment 201 is adapted to be strung on the shoe 200 so as to form a criss-cross pattern on the eyelet tabs 210, and has distal ends 2011 concealed by the eyelet tabs 210. The second lace segment 202 includes first and second lace portions 203, 204. Each of the first and second lace portions 203, 204 has a lower section 2031, 2041 connected to the first lace segment 201 so as to be adapted to be anchored on a respective one of the eyelet tabs 210, and an upper section 2032, 2042 opposite to the lower section 2031, 2041.

Each of the loop assemblies 30 includes a first loop segment 301, a second loop segment 302, and a distal lace segment 303. The first loop segment 301 is connected to the upper section 2032, 2042 of a respective one of the first and second lace portions 203, 204. The second loop segment 302 extends integrally from the first loop segment 301. The distal lace segment 303 has a first distal lace section 3031 that is fixed on the first loop segment 301 by stitching, and a second distal lace section 3032 that serves as a free end.

Figure 4:
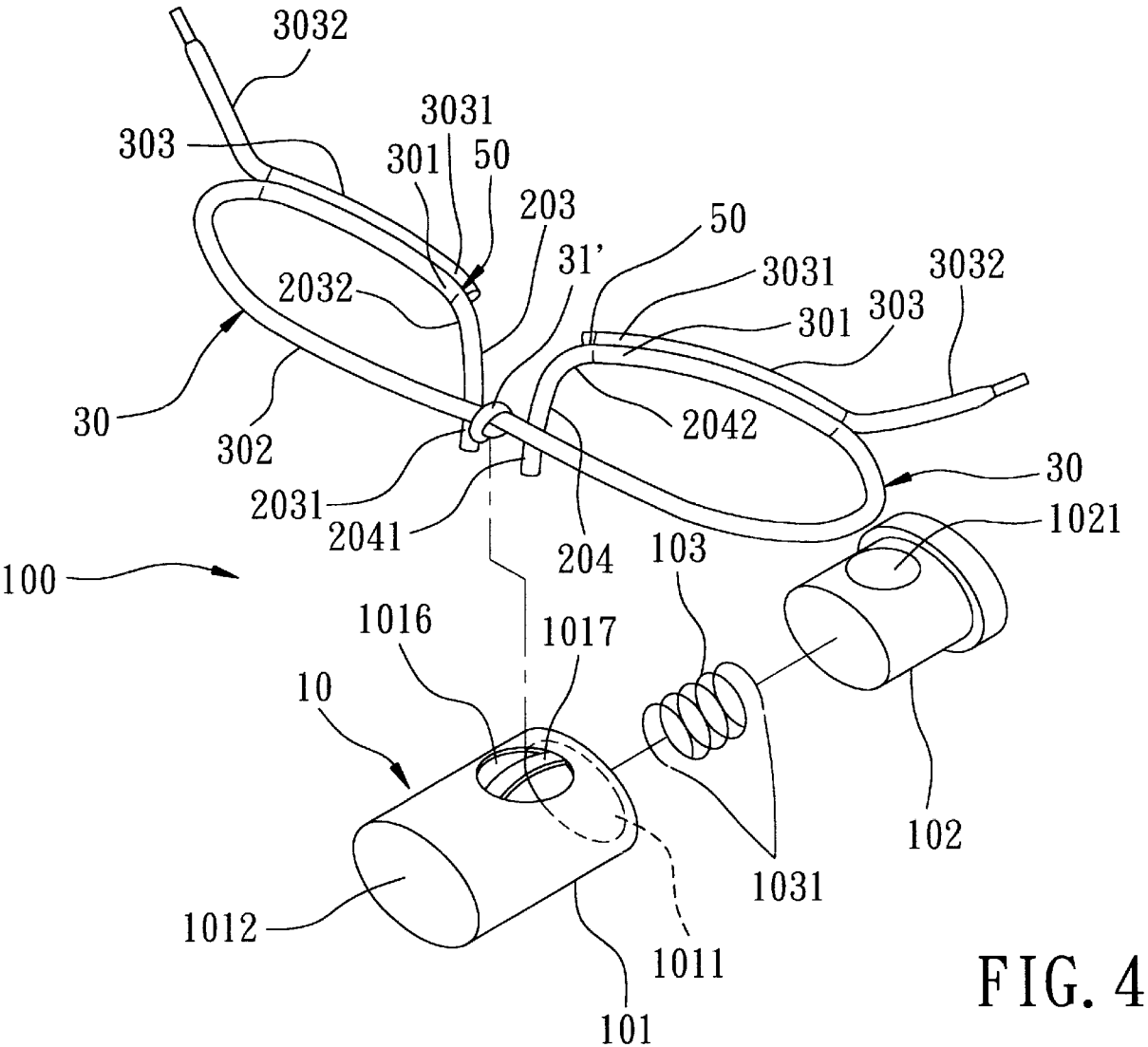
FIG. 4 is an exploded perspective view of the preferred embodiment.
Figure 5:
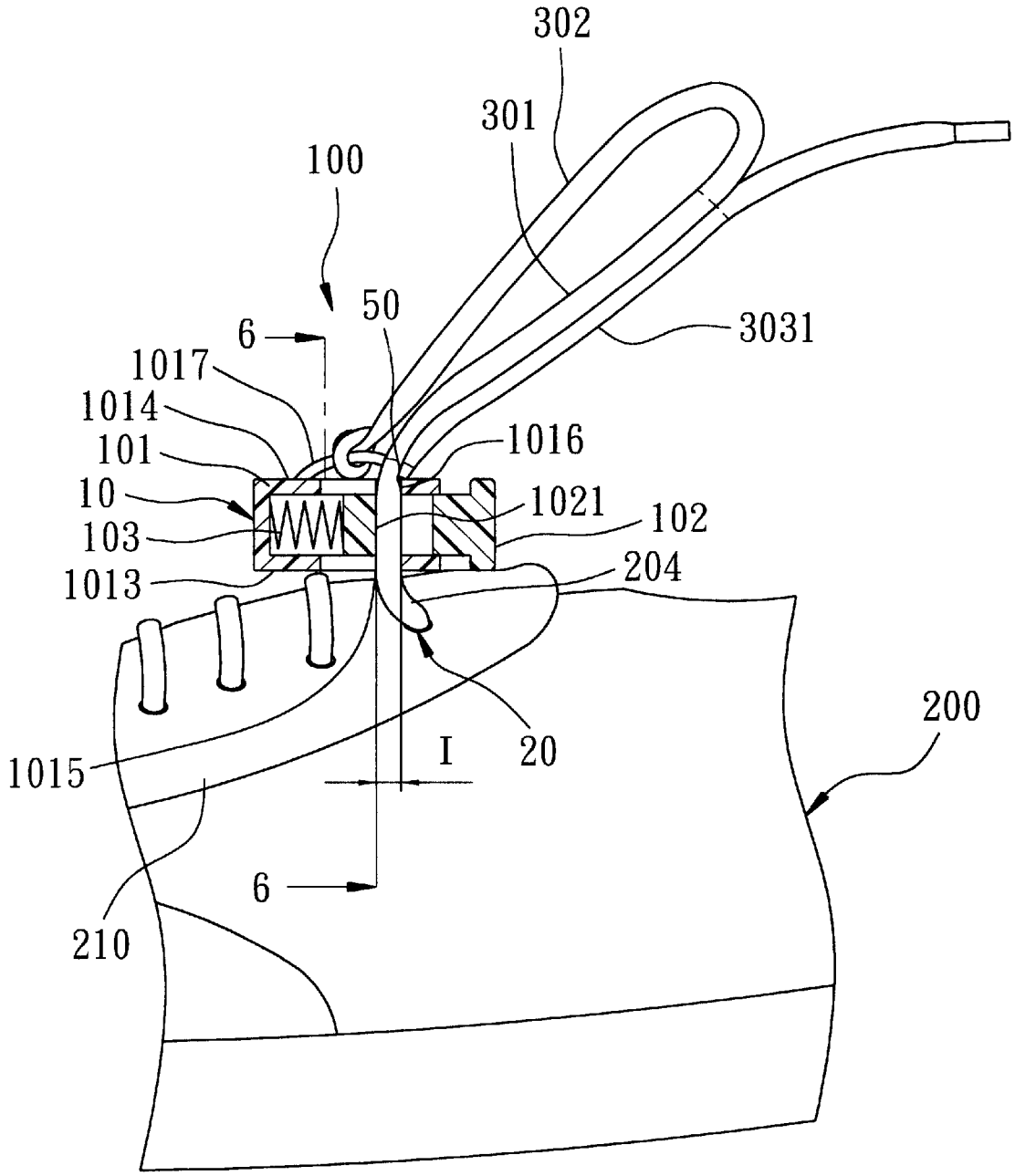
FIG. 5 is a fragmentary schematic partly sectional view showing the shoe with the preferred embodiment in a tightened state.
Figure 6:
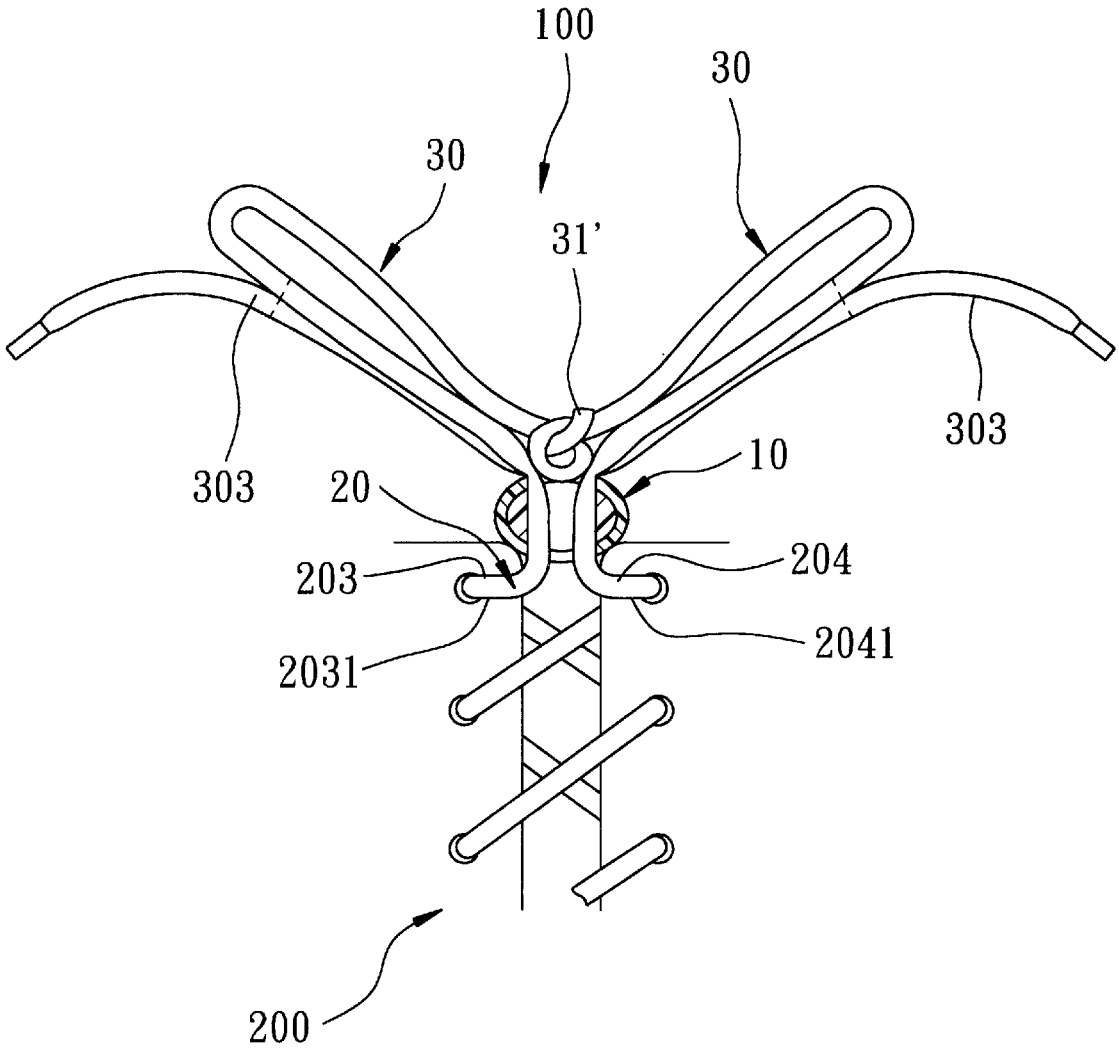
FIG. 6 is a sectional view of the first preferred embodiment taken along line 6—6 of FIG. 5.

The clamp member 10 is sleeved slidably on the loop assemblies 30, and includes an elongate casing 101, a clamping block 102, and a biasing member 103 (see FIG. 4). The elongate casing 101 has a front open end 1011, and a rear closed end 1012 opposite to the front open end 1011 in a first direction. The casing 101 includes top and bottom wall parts 1014, 1013 opposite to each other in a second direction transverse to the first direction. Each of the top and bottom wall parts 1014, 1013 is formed with a loop hole 1016, 1015 that permits extension of the first loop segment 301 of each of the loop assemblies 30 therethrough. The casing 101 further has a bridging rod 1017 disposed over the loop hole 1016 in the top wall part 1014. The clamping block 102 is slidably received in the casing 101 via the front open end 1011, and is formed with a slot unit 1021 that corresponds to the loop holes 1016, 1015 in the top and bottom wall parts 1014, 1013 of the casing 101. The biasing member 103, in the form of a coil spring, is disposed in the casing 101, and has opposite ends 1031 that abut respectively against the clamping block 102 and the rear closed end 1012 of the casing 101.

The second loop segment 302 of each of the loop assemblies 30 is secured on the casing 101 to prevent removal of the clamp member 10 from the loop assemblies 30. In this embodiment, the second loop segments 302 of the loop assemblies 30 are tied together to form a decorative knot 31'. The knot 31' is tied fixedly on the bridging rod 1017 of the casing 101 of the clamp member 10. The biasing member 103 biases the clamping block 102 outwardly of the front open end 1011 of the casing 101 so as to misalign the slot unit 1021 relative to the loop holes 1016, 1015 in the top and bottom wall parts 1014, 1013, thereby clamping the first loop segments 301 of the loop assemblies 30 between the clamping block 102 and the casing 101.

Downward movement of the clamp member 10 along the first loop segments 301 of the loop assemblies 30 brings the lower sections 2031, 2041 of the first and second lace portions 203, 204 closer together for tightening the shoe 200. Upward movement of the clamp member 10 along the first loop segments 301 of the loop assemblies 30 permits the lower sections 2031, 2041 of the first and second lace portions 203, 204 to move away from each other for loosening the shoe 200.

In a tightening state of the shoe 200, the slot unit 1021 in the clamping block 10 is misaligned with the loop holes 1016, 1015 in the casing 101 (see FIG. 5), thereby forming a first clamp area (I). When the clamping block 10 is operated to compress the biasing member 103, as shown in FIG. 7, the slot unit 1021 is aligned with the loop holes 1016, 1015, thereby forming a second clamp area (II), which is larger than the first clamp area (I). Each first loop segment 301 cooperates with the first distal lace section 3031 of a respective one of the distal lace segments 302 so as to define a blocking portion 50 having a cross-sectional area larger than the first clamp area (I) but smaller than the second clamp area (II). As such, each of the blocking portions 50 can extend through the clamp member 10 via the second clamp area (II) so as to loosen the shoe 200.

In use, the loop assemblies 30 or the second distal lace sections 3032 of the distal lace segments 303 are pulled apart from each other so that the clamp member 10 will be forced to slide downwardly along the loop assemblies 30 until the blocking portions 50 of the loop assemblies 30 extend out of the top wall part 1014 of the clamp member 10. At this time, the lower sections 2031, 2041 of the lace portions 203, 204 are close to each other, thereby tightening the shoe 200 (see FIG. 5). To loosen the shoe 200, the clamping block 102 is operated to compress the biasing member 103, thereby aligning the loop holes 1016, 1015 with the slot unit 1021 (see FIGS. 3, 5 and 6). Then, by moving the clamp member 10 upwardly along the loop assemblies 30 until the blocking portions 50 of the loop assemblies 30 extend out of the bottom wall part 1013 of the clamp member 10, the lower sections 2031, 2041 of the lace portions 203, 204 can be moved away from each other, thereby loosening the shoe 200 (see FIG. 7).

Figure 3:
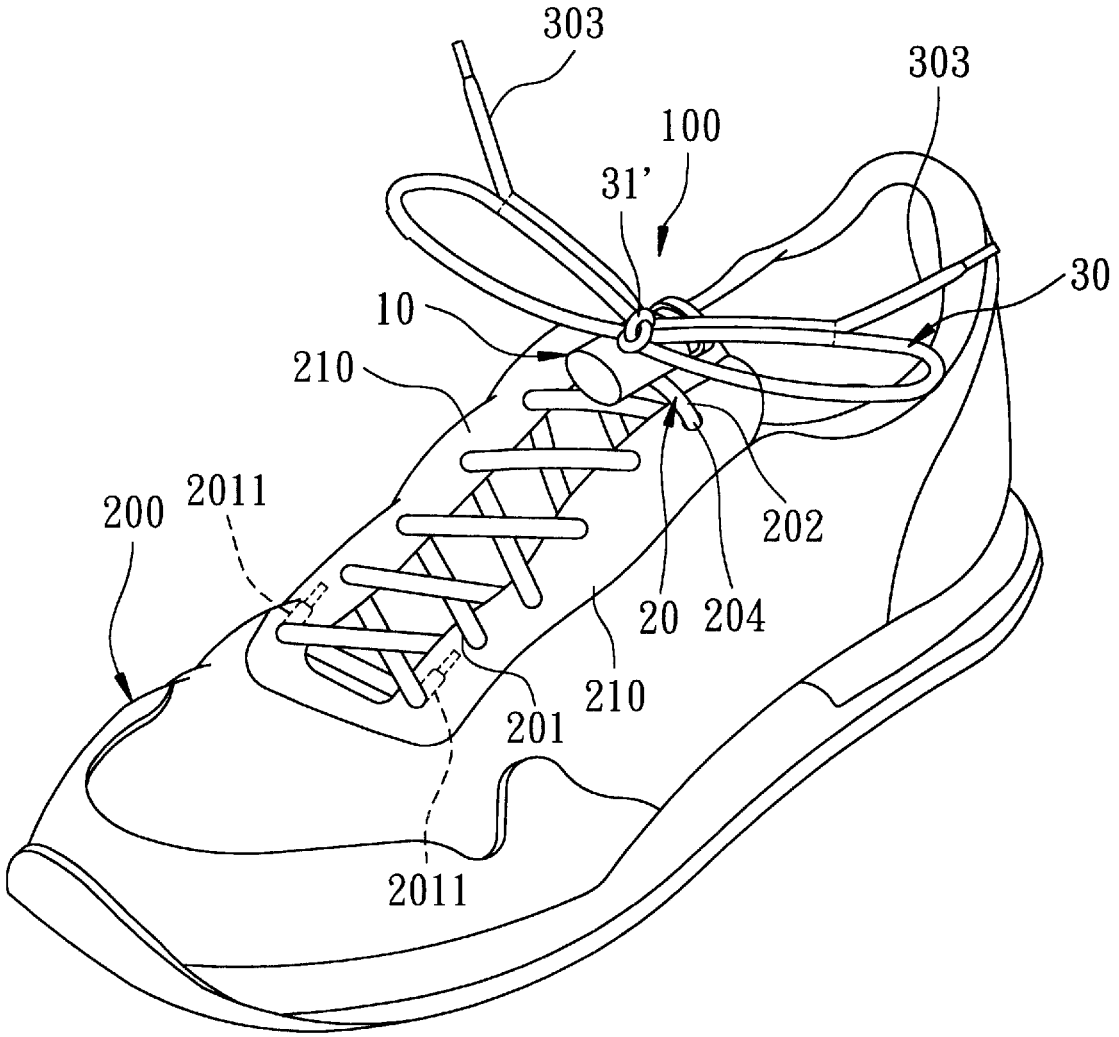
FIG. 3 is a perspective view of a shoe that incorporates the preferred embodiment of a double-bow shoe lace device according to the present invention.

The decorative knot 31' cooperates with the loop assemblies 30 to form a double-bow configuration, as best illustrated in FIG. 3.

Thus, the shoe 200, incorporating the double-bow shoe lace device 100 of the present invention, is not only easy to wear and remove, but also has an attractive appearance in view of the double-bow configuration of the shoe lace device 100. Furthermore, the shoe lace device 100 is simple since the clamp member 10 is sleeved on the loop assemblies 30, and is reliable because of the presence of the blocking portions 50 on the loop assemblies 30 which have a cross-sectional area larger than the first clamp area (I) but smaller than the second clamp area (II), thereby guarding against removal of the loop assemblies 30 from the clamp member 10 in a non-compressed state of the clamp member 10.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A double-bow shoe lace device for a shoe with a pair of eyelet tabs, said shoe lace device comprising:

a shoe lace having first and second lace segments, said first lace segment being adapted to be strung on the shoe so as to form a criss-cross pattern on the eyelet tabs, said second lace segment including first and second lace portions, each of said first and second lace portions having a lower section connected to said first lace segment so as to be adapted to be anchored on a respective one of the eyelet tabs, and an upper section opposite to said lower section;

two loop assemblies, each of which includes a first loop segment connected to said upper section of a respective one of said first and second lace portions, a second loop segment extending integrally from said first loop segment, and a distal lace segment fixed on said first loop segment; and a clamp member sleeved slidably on said loop assemblies and having said second loop segment of each of said loop assemblies secured thereto, downward movement of said clamp member along said first loop segments and said distal lace segments of said loop assemblies bringing said lower sections of said first and second lace portions closer together for tightening the shoe, upward movement of said clamp member along said first loop segments and said distal lace segments of said loop assemblies permitting said lower sections of said first and second lace portions to move away from each other for loosening the shoe.

2. The double-bow shoe lace device as claimed in claim 1, wherein said clamp member includes an elongate casing having a front open end, and a rear closed end opposite to said front open end in a first direction, said casing including top and bottom wall parts opposite to each other in a second direction transverse to the first direction, each of said top and bottom wall parts being formed with a loop hole that permits extension of said first loop segment of each of said loop assemblies therethrough, a clamping block slidably received in said casing via said front open end, said clamping block being formed with a slot unit that corresponds to said loop holes in said top and bottom wall parts of said casing, and a biasing member disposed in said casing and having opposite ends that abut respectively against said clamping block and said rear closed end of said casing, said second loop segment of each of said loop assemblies being secured on said casing to prevent removal of said clamp member from said loop assemblies, said biasing member biasing said clamping block outwardly of said front open end of said casing so as to misalign said slot unit relative to said loop holes in said top and bottom wall parts, thereby clamping said first loop segments and said distal lace segments of said loop assemblies between said clamping block and said casing.

3. The double-bow shoe lace device as claimed in claim 2, wherein said second loop segments of said loop assemblies are tied together to form a decorative knot that is secured on said casing.

4. The double-bow shoe lace device as claimed in claim 3, wherein said casing further has a bridging rod disposed over said loop hole in said top wall part, said knot being fixed on said bridging rod.

5. The double-bow shoe lace device as claimed in claim 2, wherein said slot unit in said clamping block is misaligned with said loop holes in said casing during tightening of the shoe to form a first clamp area, and is aligned with said loop holes in said casing during loosening of the shoe to form a second clamp area, which is larger than said first clamp area.

6. The double-bow shoe lace device as claimed in claim 5, wherein said distal lace segment of each of said loop assemblies is fixed on said first loop segment by stitching, and cooperates with said first loop segment to define a blocking portion having a cross-sectional area larger than said first clamp area but smaller than said second clamp area.

* * * * *